United States Patent [19]

Dondelewski

[11] 4,391,608

[45] Jul. 5, 1983

[54] PROCESS FOR THE BENEFICIATION OF CARBONOUS MATERIALS WITH THE AID OF ULTRASOUND

[76] Inventor: Michael A. Dondelewski, 5354 Fortress Trail, Columbus, Ohio 43230

[21] Appl. No.: 289,536

[22] Filed: Aug. 3, 1981

Related U.S. Application Data

[63] Continuation of Ser. No. 135,241, Mar. 31, 1980, abandoned.

[51] Int. Cl.[3] ..... C10L 1/00; C07G 13/00; C01B 31/02

[52] U.S. Cl. ..... 44/1 SR; 204/157.15; 204/158 S; 423/461; 423/578 A; 201/17

[58] Field of Search ..... 423/460, 461, 578 A; 44/1 R, 1 SR; 204/157.1 S, 158 S; 201/17

[56] References Cited

U.S. PATENT DOCUMENTS

| | | | |
|---|---|---|---|
| 3,497,005 | 2/1970 | Pelopsky | 204/158 S |
| 3,616,375 | 10/1971 | Inoue | 204/157.1 S |
| 4,108,759 | 8/1978 | Young | 204/157.1 S |
| 4,156,593 | 5/1979 | Tarpley, Jr. | 44/1 SR |
| 4,167,397 | 9/1979 | Grant | 44/1 SR |

FOREIGN PATENT DOCUMENTS

| | | | |
|---|---|---|---|
| 183430 | 3/1923 | United Kingdom | 44/1 A |
| 2023172 | 12/1978 | United Kingdom | 44/1 R |

*Primary Examiner*—Gary P. Straub

*Attorney, Agent, or Firm*—Webb, Burden, Robinson & Webb

[57] ABSTRACT

A process for reducing the sulfur and ash content of coal and the like by treatment in an aqueous slurry with ultrasound followed by subsequent separating steps.

7 Claims, No Drawings

PROCESS FOR THE BENEFICIATION OF CARBONOUS MATERIALS WITH THE AID OF ULTRASOUND

This application is a continuation of application Ser. No. 135,241, filed Mar. 31, 1980 now abandoned.

BACKGROUND

Coal as a fuel is an abundant resource of energy comprising mostly carbon, and small percentages of hydrogen, sulfur and ash. When coal is burned to produce energy, the presence of the sulfur and ash is generally undesirable. The ash enters the atmosphere as small particles (particulates) and the sulfur as noxious sulfur oxide gases. Sulfur is present in coal in three principal forms: pyritic sulfur (a combination of iron and sulfur); sulfate sulfur, generally in very small quantities, say 0.5 to 0.1 percent by weight; and organic sulfur, that is chemically combined sulfur within the coal structure.

Pyritic sulfur can, to a large extent, be washed out of coal by conventional coal washing methods. These methods are not, however, suitably efficient on a large scale and at best only a small portion of the mined coal can be sufficiently up-graded by washing alone.

Sulfate sulfur can easily be separated from coal by dissolving it in water. For example, it may boiled out of the coal matrix by elevated temperature processes which have already been developed.

At the present time there appears to be no commercial process for removing organic sulfur from coal. Removal of organic sulfur requires drastic chemical treatment causing the breaking of bonds between the sulfur and the carbon within the structure of the coal molecule. Where the sulfur content of coal is very near the permissible level as designated by government anti-pollution laws and regulations, it still may not be possible to economically upgrade the coal by removal of organic sulfur. Thus, it becomes necessary to treat exhaust gases with expensive scrubbers which use large quantities of chemicals and which can create additional pollution problems.

Processes have been conceived and to some extent developed for removal of a portion of the organic sulfur coal. At this time, they require very expensive treatment facilities utilizing high pressures say up to 500 to 1,000 psi, and temperatures up to 600° F. (about 400° C.). Clearly, from an engineering and processing point of view, it does not make sense to treat coal in order to reduce the initial sulfur content of the coal from say 1.5% to a 0.6 to 0.8% level by use of these processes.

Summarizing the numerous processes which have been proposed for upgrading coal to remove various forms of sulfur, the following have been considered: (1) Oxidation of sulfur in the coal in an aqueous medium to form soluble sulfates; (2) reduction of the sulfur to elemental sulfur in which form it can be vaporized or removed by organic solvents; (3) reaction with hydrogen to form gaseous hydrogen sulfide; (4) vapor deposition selectively on the pyritic form of sulfur followed by magnetic separation of the pyrites; (5) oxidation of the sulfur with nitric oxide vapors to form gaseous sulfur oxides; (6) leaching with a sodium and calcium oxide lixiviant; and (7) leaching with aqueous ferric sulfate.

The applicant's process disclosed herein has the potential for providing a commercial process for removal of the three basic forms of sulfur from coal and coal-like materials. At the same time, the process reduces the amount of ash within the coal or coal-like material. The process involves the use of atmospheric pressures and low temperatures (temperatures near room temperature) and may be practiced with rugged processing equipment.

BRIEF DESCRIPTION OF THE INVENTION

Briefly according to this invention, there is provided a method of treating coal and coal-like materials to reduce the sulfur content. The method comprises the first step of crushing and sizing the coal to a more or less uniform size. Particular size to be selected depends upon the type of coal and the amount of sulfur that must be removed and of course the type of sulfur within the coal itself. Certain coals have been found to respond to treatment very well if crushed to pass one-quarter inch mesh screen. It should be understood that the process described herein can be used for the treatment of residue from coal washing processes sometimes referred to as pond coal, in which case the starting material is already very fine, say minus 28 mesh Tyler. In this instance, it is not necessary to crush and size the coal starting material. The second step comprises combining the coal with water in a bath to form a slurry. A third step comprises applying ultrasound to the slurry. This may be done in either of two ways. The slurry may be dumped into a large tank to which ultrasound is applied for some relatively long period of time followed by draining the tank. On the other hand, the slurry may be continuously pumped through an ultrasound cell where it is resident in the cell for only a relatively short period of time. A fourth step comprises removing the coal from the water and washing the coal to recover a coal with a reduced sulfur and ash content. According to preferred methods, a small amount of oil is added to the slurry. The oil appears to aid in the displacement of organic sulfur from the coal structure via the action of ultrasound. The oil added to the slurry is preferably added in an amount between a stoichiometric ratio of sulfur to oil of 1:1 and 1:5. A further preferred embodiment involves the addition of sodium chloride to the slurry.

It is preferable that the applied frequency of the ultrasound be between about 20 and 40 kilocycles per second and that the temperature of the slurry be maintained less than about 75° C.

DESCRIPTION OF THE PREFERRED EMBODIMENTS

Further features and other objects and advantages of this invention will become clear from a study of the following examples.

EXAMPLE 1

A specimen of low sulfur metallurgical quality coal having a raw sulfur content of 0.89% by weight was crushed and sized to pass one-quarter inch mesh screen and to rest upon a 100 mesh screen.

A portion of the specimen was treated in a salt solution under heat and pressure (15 psi) in a process described generally in my earlier patent application, now U.S. Pat. No. 4,127,390.

Another portion of the specimen was treated in a salt solution with ultrasonic vibration. The solution comprised 500 ml of water with 13 grams of sodium chloride and 7 grams of sodium carbonate added thereto. The slurry comprised 100 grams of coal and 500 ml of salt solution. In the case of the specimen treated by ultrasound, the slurry was subjected to ultrasonic vibrations of frequency 20 kHz for a period of 30 minutes. The power applied to the ultrasound generated was 220 watts (0.7 watts/cm$^2$).

In each instance, the fine coal was separated from the solution and washed and in each instance chemically analyzed. The sulfur content was reduced from 0.89 to 0.65 percent by treatment in the salt solution under heat and pressure, as expected from my prior work. The sulfur content of the portion of the specimen treated in the salt solution with ultrasonic vibration applied thereto was reduced from 0.89 to 0.58 percent.

Hence, the new process described herein was at least as effective as my earlier patented process and has the advantage that pressure vessels are not required for the process. To be sure, means for generating ultrasound are required. Each process has its relative advantages.

EXAMPLE II

A specimen of low sulfur coal from Kentucky was sized and slurried and treated with ultrasonic vibration substantially as was the specimen of Example I. Another portion of the same specimen was treated with a saline solution of hydrogen peroxide as generally described in my earlier application, now U.S. Pat. No. 4,183,730.

The following table sets forth the characteristics of the specimen, both before and after treatment by both processes.

| | Raw Coal | Ultrasound Treatment | Saline Solution With Hydrogen Peroxide |
|---|---|---|---|
| Ash | 14.93% | 6.21% | 7.07% |
| Sulfur | 1.14% | 0.80% | 0.91% |
| BTU/ Pound | 11,606 | 12,005 | 12,731 |

It should be noted that all analyses presented in this patent specification are based upon dry specimens.

The specimen treated by ultrasound was treated in a slurry comprising 20 grams of salt per 1 liter of water. The specimen treated in the saline solution with hydrogen peroxide comprised 200 grams of coal combined with 400 milliliters of a 6 percent solution of hydrogen peroxide and 40 grams of salt. In both cases, the coal was floated and separated from other residue. The new process disclosed herein was at least as effective at sulfur reduction, if not more so, than the process requiring the use of hydrogen peroxide.

EXAMPLE III

A specimen of high sulfur subbituminous coal from Illinois was sized into two fractions. One portion of the specimen was crushed to pass a five-eighth inch mesh screen and the other was crushed to pass a one-eighth inch mesh screen. The specimens were both treated in a saline solution substantially as described in Example 1. The following table sets forth characteristics of the raw coal compared with the specimens treated with ultrasonic vibration in a saline solution.

| | Raw Coal | Minus ⅝ Ins. | Minus ⅛ Ins. |
|---|---|---|---|
| Ash | 31.01% | 5.12% | 3.96% |
| Sulfur | 5.33% | 3.00% | 2.59% |
| BTU/pound | 9,328 | 11,909 | 11,843 |

The saline solutions comprise 40 grams of salt per 500 ml of water to which was added 200 grams of sized coal.

The specimen treated with ultrasonic vibration was washed and the coal floated from the residue. The power applied to the ultrasonic vibrator was about 220 watts. This example establishes that the smaller particle size coal had a greater ash and sulfur reduction. The raw coal for this example was typically analyzed for type of sulfur as follows: pyritic sulfur 2.73%; sulfate sulfur 0.40%; organic sulfur 2.06% for a total of 5.19%.

On the basis of this analysis, it may be concluded that the process described with reference to this example does not easily remove organic sulfur. It was conceived that the ultrasound might be more effective if a hydrocarbon substance were provided to replace the sulfur within the structure of the coal as it is broken free by the ultrasonic action in the presence of salt.

EXAMPLE IV

An apparatus for continuously treating a coal slurry was set up to pump the slurry from one tank through an ultrasonic processing cell to a second tank. The cell was equipped with a booster horn capable of transmitting industrial power level vibrations into the cell. The slurry of coal from Example III (minus one-eighth inch) was made up as follows: 4 pounds of coal; 5 gallons of water; 20 grams of salt; 20 grams of sodium carbonate; vegetable oil present in a stoichiometric 1 to 1 ratio to organic sulfur present in the coal.

The slurry was pumped through the ultrasonic cell at the rate of three-eighths gallon per minute. After treatment, the coal was cleaned with hot tap water and the sample floated in a froth flotation cell to separate the coal from the liquid and gangue in the process slurry. The coal after treatment analyzed:

| | |
|---|---|
| Ash | 4.07% |
| Sulfur | 0.122% |
| BTU/pound | 19,483. |

EXAMPLE V

A sample of Pittsburgh seam coal residue from a coal washing process, so called pond coal, being a very fine material (minus 200 mesh) was processed substantially as described in Example IV. The coal was also processed with the addition of vegetable oil. The results of processing are set forth in the following table.

| | Raw Pond Coal | Treated In Brine Slurry | Treated In Brine Slurry With Vegetable Oil Added |
|---|---|---|---|
| Ash | 38.27% | 4.10% | 4.07% |
| Sulfur | 1.42% | 1.07% | 0.125% |
| BTU/ pound | 8,598 | 14,065 | 15,503 |

The salt concentration for the specimen treated in brine only was 20 grams of salt per 100 grams of coal in 15 liters of water. The salt concentration for the specimen treated in brine with addition of vegetable oil was 15 grams of salt per 200 grams of coal in 15 liters of water.

Another specimen of the pond coal was simply floated in a froth flotation cell. No significant reduction of sulfur was demonstrated. Furthermore, ash reduction was not as effective. Results of mere floating the coal are set forth in the following table.

| | |
|---|---|
| Ash | 5.03% |
| Sulfur | 1.22% |
| BTU/pound | 12,705. |

A specimen of the coal described in Example IV was slurried and treated with vegetable and ultrasound only. At this point, the treated coal analyzed as follows: Ash-4.11%; Sulfur-0.96%; BTU/pound-11,140.

This test established that satisfactory results may be obtained without the use of sodium chloride in the water used to slurry the coal prior to ultrasonic treatment. In some instances, the addition of salt to the solution used to form the coal slurry may be detrimental. It is believed that the chlorine content of the coal may build up as chlorine replaces organic sulfur.

The treated slurry of this example was then mixed with distilled water plus a coal depressant. Tiny solids coagulated on the top of the mixture and were skimmed off the top and chemically analyzed. The skimmings analyzed 3.31% by weight elemental sulfur. The point here is that the tendency for the coal to float after ultrasound treatment and the tendency of minuscule elemental sulfur particles to form (not even visible with the naked eye) can result in elemental sulfur reconcentrating with the coal. It is preferable to keep the coal particles sufficiently large so that they may be depressed (caused to sink) and to thereby enable the elemental sulfur to be washed away or skimmed off.

Another specimen of the coal treated as described in this example (Example IV-A) was mixed with sodium chloride in a 3% solution of hydrogen peroxide. This was done because the mixing of the elemental sulfur with the coal was apparent. The sulfur content of the washed coal (washed subsequent to treatment with sodium chloride and hydrogen peroxide solution) was remarkably low, that is, 0.0007% by weight. The point here is that the ultrasound treatment frees elemental sulfur but a careful unmixing of the elemental sulfur and coal is required. Described in this paragraph is a chemical unmixing which results in a washing liquor analyzing 0.06% sulfur and having a pH of 1.8. Obviously, this washing liquor itself comprises a disposal problem and hence physical separation techniques for separating the elemental sulfur and coal are preferred.

EXAMPLE VI

A composite sample of an Ohio coal crushed to all pass 100 mesh Tyler was estimated to have the following properties.

| | |
|---|---|
| Ash | 12% |
| Sulfur | 2.2% |
| BTU/pound | 11,000 |

Because this was a composite sample, the values given are only approximate. The composition was treated substantially as described with reference to Example V but with no addition of vegetable oil. The results of treatment were as follows.

| | |
|---|---|
| Ash | 4.86% |
| Sulfur | 0.90% |

-continued

| | |
|---|---|
| BTU/pound | 13,690. |

EXAMPLE VII

A particularly difficult to treat Ohio coal (subbituminous) has the following characteristics.

| | |
|---|---|
| Ash | 15.71% |
| Sulfur | 4.84% |
| BTU/pound | 9,166 |

Treatment with brine and ultrasound produced a coal product having the following characteristics.

| | |
|---|---|
| Ash | 4.8% |
| Sulfur | 3.53% |
| BTU/pound | 10,385 |

Treatment with oil and ultrasound (that is, no salt added) produced a coal product having the following characteristics.

| | |
|---|---|
| Ash | 5.46% |
| Sulfur | 3.82% |
| BTU/pound | 10,526 |

This example establishes that the degree with which the process disclosed herein is effective for removing sulfur depends upon the characteristics of the coal itself.

EXAMPLE VIII

A larger particle size subbituminous coal was treated with brine in a vessel with applied ultrasound. The particular coal was of relatively large particular size, one and three-quarter inches and down. The characteristics of the coal before and after treatment are set forth in the following table.

| | Raw | Treated |
|---|---|---|
| Volatile matter | 29.88% | 27.65% |
| Fixed carbon | 55.89% | 65.66% |
| Ash | 14.23% | 6.69% |
| | 100.00% | 100.00% |
| Sulfur | 7.75% | 2.55% |
| BTU/pound | 9,161 | 10,149 |

It has been known that coal containing sulfur as pyrites can be nicely upgraded by "floating" fine coal to separate ash and pyritic sulfur. Floating is a type of washing process. Washing techniques do not concentrate sulfur in the coal recovered because while ash containing no sulfur is removed, part of the sulfur containing pyrites are also removed. Of course, the organic sulfur prevails and cannot be removed by washing. Coal is normally floated at some specific gravity, say within the range of 1.1 to 1.7. In this instance, a large portion of the ash and pyrite sinks.

When a fine coal slurry is treated ultrasonically, as described herein, the flotation process is enhanced. More coal appears to float even in plain water than with conventional floating techniques. More coal can therefore be recovered. Difficult to float coals tend to coagulate on the top of water after ultrasound treatment.

The used washing water left over from the process disclosed herein need not be extensively treated with neutralizer as with other desulfurization processes, for the reason that the amount of sulfur converted to sulfuric acid is much less. The elemental sulfur and inorganic matter removed from the coal can be removed from the water by conventional methods of coagulation and filtration.

After application of ultrasound to the coal slurry according to this invention, elemental sulfur and pyrites are often present in very fine particular size making the separation of the sulfur and pyrites from the coal a process requiring careful attention. A first step should comprise separating the coarser coal in a deep tank, hydrocyclone, screen or whatever available equipment. Coarser coal at this point will sink to the bottom of a deep tank. (This is the least expensive method of removing the coal from the liquor.) Liquor may be decanted from the top of the vessel and coal slurry pumped from the bottom of the vessel to a second tank. A second step will involve rinsing the coal with clear water. It has been found that the microscopic pyrites and sulfur particles will readily float in the rinse water and can be skimmed from the top of the tank in which the coal is being rinsed. Surface wetting agents may be employed for the purpose of preferentially wetting the coal surfaces. These agents tend to depress the coal and enhance the sulfur extraction because the sulfur will float much better. A number of products are available as wetting agents and include the following sold by trademark or trade name: Aero Depressant 633; Aerosol MA; Triton X-100; and Santomerse S. These agents would typically be added in an amount of about ½ pound or more per ton of coal.

The applicant does not wish to be tied down to any specific mechanism for explaining the effect of ultrasonic vibration upon the coal slurry to aid in the removal of sulfur. However, the following thoughts may be pertinent. Ultrasonic treatment of various liquids and solids has been known for some time to promote chemical changes. Numerous frequency ranges of ultrasonic vibration have been experimented with. There has been found a phenomenom known as cavitation which is induced in liquids and slurries by ultrasonic vibration. Cavitation is the formation of partial vacuums within the liquid. Ultrasonically induced cavitation appears to promote chemical changes of substances within the liquid. Agitation itself provided by ultrasound may produce physical and chemical changes within the liquid to which the sound is applied. For ultrasonic treatment, when water is used as treatment medium, cavitation and agitation may both be involved. Most such applications require frequency ranges of 20 to 40 kilocycles per second. Cavitation effects may be most pronounced by using either magnetostrictive or ceramic sources for generation of ultrasonic waves.

Of course temperature affects the speed and frequency of ultrasonic waves within a given medium. Generally at about a temperature of 73° C. cavitation and frequency of ultrasonic waves within water begins to deteriorate. It is therefore desirable to maintain the maximum temperature. The slurry is used in this process below 75° C.

The applicant hypothesizes that the coal molecules which are very large chain hydrocarbons connected in many ways to both organic and inorganic elements can be disturbed by ultrasound. Following this reasoning, one may conclude that upon breaking apart the molecular chains of the hydrocarbon structure some loose ends will remain actively seeking to form or reform. Thus if a sulfur atom tied to a hydrocarbon molecule of the coal is removed, it will leave behind an active site seeking to replace the "lost" sulfur atom. By having present in the slurry a vegetable oil (which is a somewhat reactive oil) the active site can be satisfied by the oil rather than by recombination with the sulfur molecule. This may be the basis for explanation of the excellent result of the process as exemplified in Examples IV and V.

Oils that were used in Examples IV and V were vegetable oils which are members of a group of semi-reactive oils known as fixed oils—fatty substances of vegetable and animal organisms—containing esters of fatty acids. It is expected that volatile or essential oils—odorous principals of vegetable organisms—containing terpenes and related camphors would also be effective. Further, it is believed that mineral oils derived from petroleum and its products would be effective.

Where the product of the process according to this invention is very fine coal, say 100 to 400 mesh Tyler, there exists at least two methods of utilizing the processed coal. It may be mixed with fuel oil and the fuel oil and coal mixture processed through oil burners to thus reduce the total amount of oil required in a given application. In this case, the oil may be floated on a tank over which the fine coal has been caused to coagulate and float. The coal will move into the oil and be carried away from the tank by the oil. In another embodiment, the oil and water may be vigorously stirred together and then the oil and coal mixture allowed to rise and float over the top of the water prior to separation.

Where the fine coal is to be used with a stoker, it must be pelletized prior to use, for example as taught in my U.S. patent application Ser. No. 23,744, filed Mar. 26, 1979.

The examples herein illustrate the usefulness of adding small amounts of certain chemical agents such as salt, sodium carbonate, and hydrogen peroxide to the coal slurry prior to the ultrasound treatment (see also my U.S. Pat. Nos. 4,183,730 and 4,127,390). Other agents may be added to the slurry, for example, small amounts of semi-reactive oil as explained herein. Certain of the agents can be profitably added together to the coal slurry, for example salt and semi-reactive oil. It has also been discovered that sodium hydroxide is an excellent agent to add to the coal slurry prior to treatment of the coal slurry with ultrasound. However, oil may not also be added to the slurry when sodium hydroxide is added. Otherwise, the oil and sodium hydroxide will react to form a soap. Extremely pure coal (very low in sulfur) can be obtained using a process described herein with sodium hydroxide as an agent in the slurry in at least a stoichiometric 1 to 1 ratio of sodium hydroxide to the organic sulfur in the coal present in the slurry.

Having thus described my invention with the detail and particularly required by the Patent Laws, what is desired protected by Letters Patent is set forth in the following claims.

I claim:

1. A method of treating coal to reduce ash and sulfur content comprising the steps for:

(a) combining the coal with water and oil to form a slurry, said oil being a semi-reactive oil containing esters of fatty acids, (b) applying ultrasound to said slurry to cause separation of ash from coal and sulfur including organic sulfur from coal, (c) physically separating coal and adhered oil from the slurry and washing to separate ash and sulfur from the coal to recover coal with reduced sulfur and ash content.

2. A method according to claim 1 wherein the coal is first crushed and sized to a more or less uniform dimension.

3. A method according to claim 1 wherein said oil is present in an amount up to 5% by weight of the coal added to the slurry.

4. A method according to claims 1 or 2 wherein sodium chloride is added to the slurry.

5. A method according to claims 1 or 2 wherein the frequency of applied sound is between 20 and 40 kilocycles per second.

6. A method according to claims 1 or 2 wherein the temperature of the slurry is maintained less than 75° C.

7. The method according to claims 1 or 2 wherein the weight ratio of coal to water in the slurry comprises between about 1:20 and 1:3.

* * * * *

UNITED STATES PATENT AND TRADEMARK OFFICE

CERTIFICATE OF CORRECTION

PATENT NO. : 4,391,608

DATED : July 5, 1983

INVENTOR(S) : Michael A. Dondelewski

It is certified that error appears in the above-identified patent and that said Letters Patent are hereby corrected as shown below:

Column 5 Line 8

Insert —EXAMPLE IV-A—.

Signed and Sealed this

*Thirtieth* Day of *August 1983*

[SEAL]

*Attest:*

GERALD J. MOSSINGHOFF

*Attesting Officer*

*Commissioner of Patents and Trademarks*